United States Patent [19]

Gerstenmaier et al.

[11] Patent Number: 4,611,729

[45] Date of Patent: Sep. 16, 1986

[54] UNIVERSAL NOZZLE BOOT FOR FUEL DISPENSER

[75] Inventors: William J. Gerstenmaier; Richard G. Bisker, both of Salisbury, Md.

[73] Assignee: Dresser Industries, Inc., Dallas, Tex.

[21] Appl. No.: 645,380

[22] Filed: Aug. 28, 1984

[51] Int. Cl.[4] ..... B67D 5/12

[52] U.S. Cl. ..... 222/75; 222/530; 222/538; 248/75

[58] Field of Search ..... 222/74, 75, 529, 530, 222/538; 141/392, 286; 248/75, 79, 80; 200/332, 335, 337

[56] References Cited

U.S. PATENT DOCUMENTS

| | | | |
|---|---|---|---|
| 1,879,876 | 9/1932 | Krause | 222/75 X |
| 2,319,867 | 5/1943 | Johnsen | 222/75 X |
| 2,413,036 | 12/1946 | De Lancey | 222/75 X |
| 2,473,848 | 6/1949 | Baxter | 200/337 X |
| 3,750,906 | 8/1973 | Hansel | 222/538 X |
| 4,195,674 | 4/1980 | Madden | 141/392 |
| 4,240,475 | 12/1980 | Schulz | 222/74 X |
| 4,252,161 | 2/1981 | Krupp | 222/538 X |

OTHER PUBLICATIONS

Gilbarco, MPD-1, "New! Multi-Product Dispenser", p. 1519.

Bennett—8000 Multi-Pro.

MEMS—Tokheim Modular Electronic Marketing System Bulletin No. 402-R, 1980.

Dresser Industries, Inc., Quadro Dispenser, DW-116A.

*Primary Examiner*—Joseph J. Rolla

*Assistant Examiner*—Michael S. Huppert

[57] ABSTRACT

A nozzle boot for a fuel dispenser in which the nozzle support hook is adjustably settable between a first position for accommodating a standard size dispenser nozzle and a second position for accommodating a larger size dispenser nozzle utilized for recovering fuel vapor while fuel is being dispensed. For electrically actuating the dispenser to enable fuel to be dispensed through the nozzle, the nozzle support is slidably displaceable for operating a linkage mechanism connected to the operating switch.

7 Claims, 10 Drawing Figures

UNIVERSAL NOZZLE BOOT FOR FUEL DISPENSER

TECHNICAL FIELD

The technical field to which the invention pertains includes the art of fluid handling as applied to apparatus for dispensing of liquid fuels.

BACKGROUND OF THE INVENTION

Fuel dispensers, commonly termed "gasoline pumps", for the fueling of automobiles or the like typically include on the dispenser housing a nozzle boot comprising a receptacle extending to within the housing for storage of the nozzle during periods of non-use. The nozzle boot provides not only for the convenience of storage but also serves as a shroud to protect the nozzle spout against the entry of dirt or moisture when stored. For some time, fuel dispensing nozzles by and large have been of a standard size such that the boots which accommodate those nozzles have likewise been of a standard size.

With the advent of the Clean Air Act, including the requirement at designated type dispensing sites for vapor recovery via the nozzle to recover vapors generated during dispensing of the fuel, it became necessary to develop new nozzle designs for that purpose. The resultant nozzles are generally of a dimensional height and length approximately one-third larger than the standard nozzle previously utilized. A nozzle boot which was therefore adequate in size for the standard nozzle has proved inadequate to accommodate the larger size nozzles utilized for vapor recovery.

As a consequence of the larger nozzle sizes, improvisation has been resorted to, such as having two different size nozzle boots in inventory and substituting one for the other as the need arose. Another approach has been the use of auxiliary nozzle supports or nozzle spout shields that enable supporting the larger nozzle while meeting the requirement of protecting the nozzle tip from the weather elements. Despite recognition of the problem, however, apparatus affording a more suitable solution has not heretofore been known.

BRIEF SUMMARY OF THE INVENTION

The invention relates to fuel dispensers and more specifically to a novel nozzle boot construction for fuel dispensers that can be adjustably set to readily accommodate nozzles of different sizes, including either the standard size nozzle or the larger nozzle utilized for vapor recovery. This is achieved in accordance with the invention by a nozzle boot in which the nozzle support hook can be adjustably preset in the course of assembly to a choice of positions for accommodating nozzles of either size.

Not only is the construction of the invention able to afford a satisfactory solution to a long-standing problem with respect to such nozzle boots, but it does so in an economical manner affording additional attributes as will be discussed.

It is therefore an object of the invention to provide a novel nozzle boot construction for a fuel dispenser readily able to accommodate different size fuel nozzles.

It is a further object of the invention to effect the foregoing objects in a highly economical manner.

BRIEF DESCRIPTION OF THE INVENTION

Figure 1:
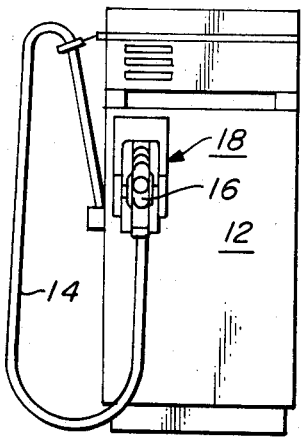
FIG. 1 is a front elevation of a fuel dispenser incorporating the nozzle boot construction of the invention.
Figure 2:
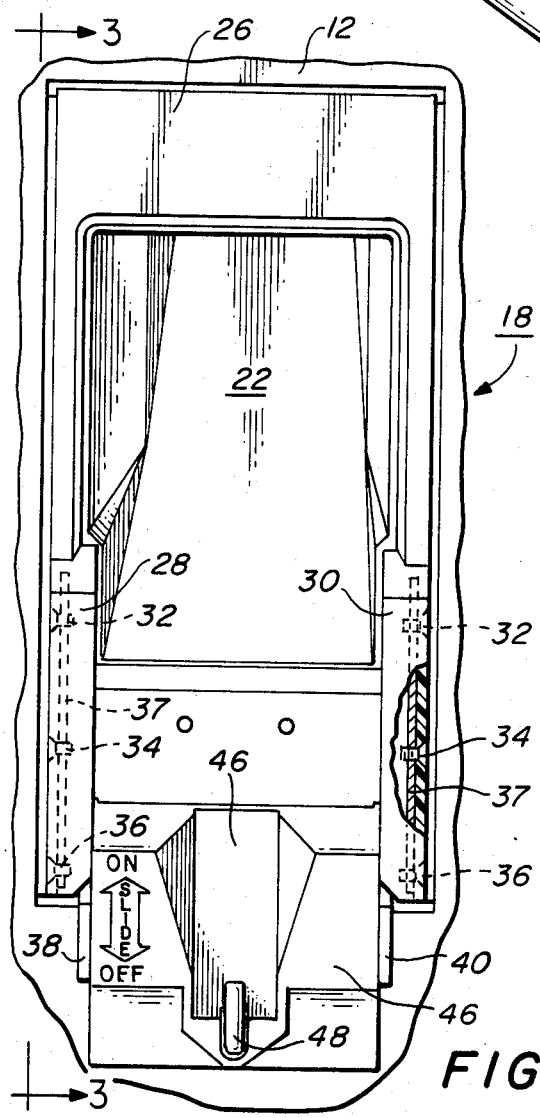
FIG. 2 is an enlarged front elevation of the boot construction of FIG. 1 preset for a vapor recovery nozzle size setting of the nozzle boot.

Referring now to the drawings, there is illustrated in FIG. 1 a fuel dispenser designated 10 comprised of a cabinet or housing 12 for enclosing the operational components of the dispenser. Emerging from the cabinet is an elongated flexible hose 14 communicating from a fuel source connection within the housing to a nozzle 16 for dispensing fuel in a well known manner. For supporting and protecting the nozzle during periods of non-use there is provided a nozzle boot receptacle 18 in accordance with the invention hereof as will be described.

Figure 7:
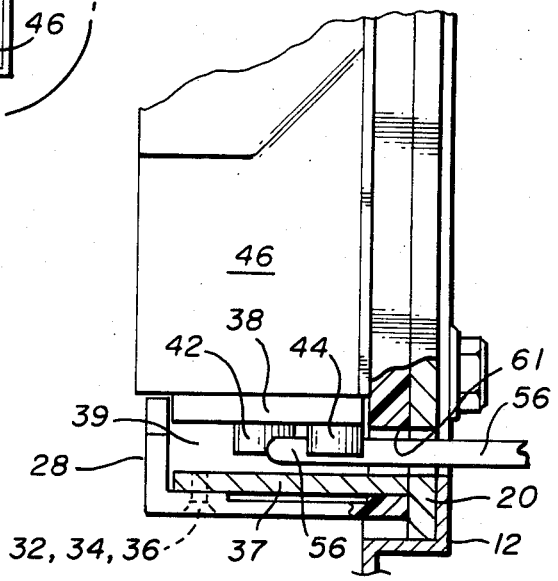
FIG. 7 is a bottom view as seen substantially from the position 7—7 of FIG. 5.
Figure 8:
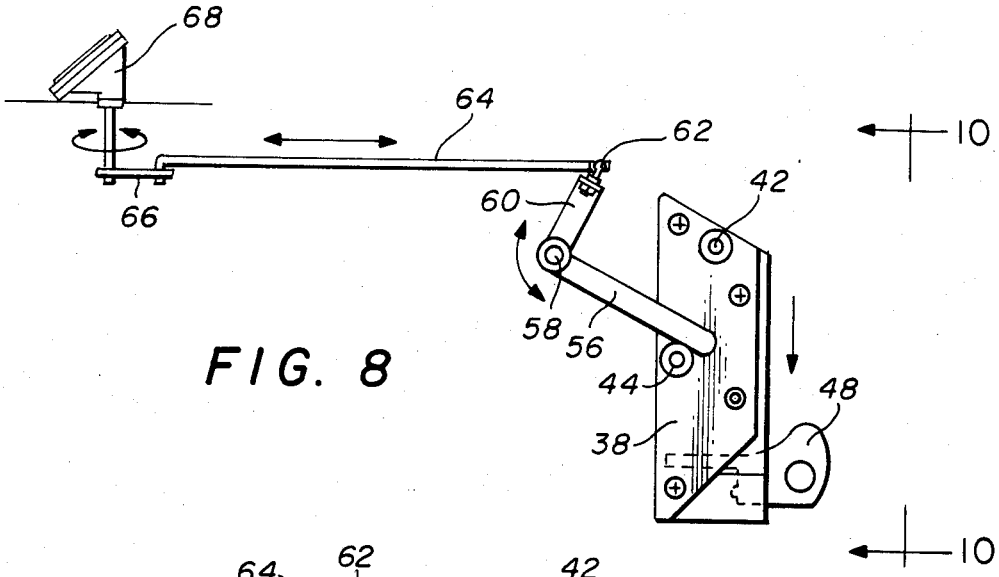
FIG. 8 is an isolated elevation of the dispenser switching mechanism in the "off" position.

Referring now to FIGS. 2–7, nozzle boot 18 is comprised of a boot-like receptacle 20 extending inward of the cabinet from an open end 22. To receive the boot, cabinet 12 includes an opening 24 about which the boot is supported via a surrounding plastic face plate 26. Integrally formed of the face plate near the lower side edges thereof are vertically extending, spaced apart, arms 28 and 30 laterally raised to form a channel 39 (FIG. 7). Each of the arms are transversely drilled and tapped at 32, 34 and 36 for connecting the face plate to upstanding boot wings 37 received within the channel. Likewise, contained within channel 39 are side bosses 42 and 44 of slideable support guides 38 and 40 for reasons as will be explained.

Secured in turn to and between the guide supports 38 and 40 is a nozzle support 46 that includes a centrally located nozzle hook 48 on which to rest nozzle 16 during periods of non-use. For the purpose of assembling the nozzle support to the opposite support guides, each side face of support 46 includes five dimensionally matched, drilled and tapped apertures 50 which can be selectively utilized to effect the appropriate setting for the nozzle size to be employed.

Figure 3:
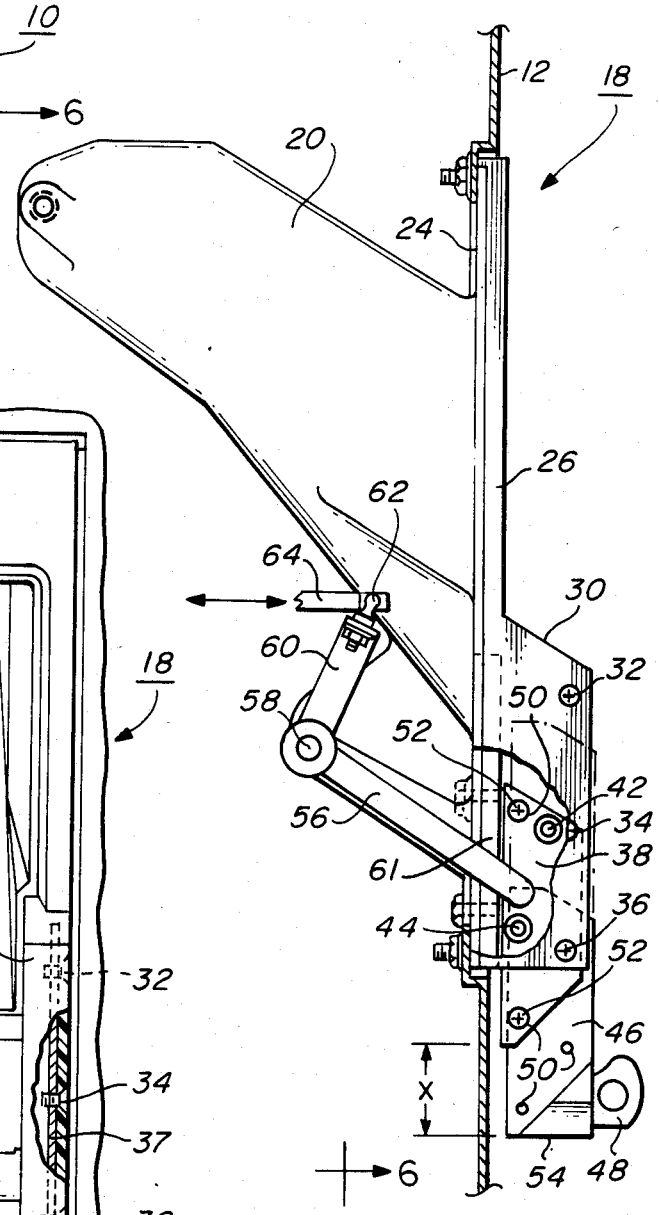
FIG. 3 is a side elevation of FIG. 2 as seen substantially from the position 3—3 of FIG. 2.
Figure 5:
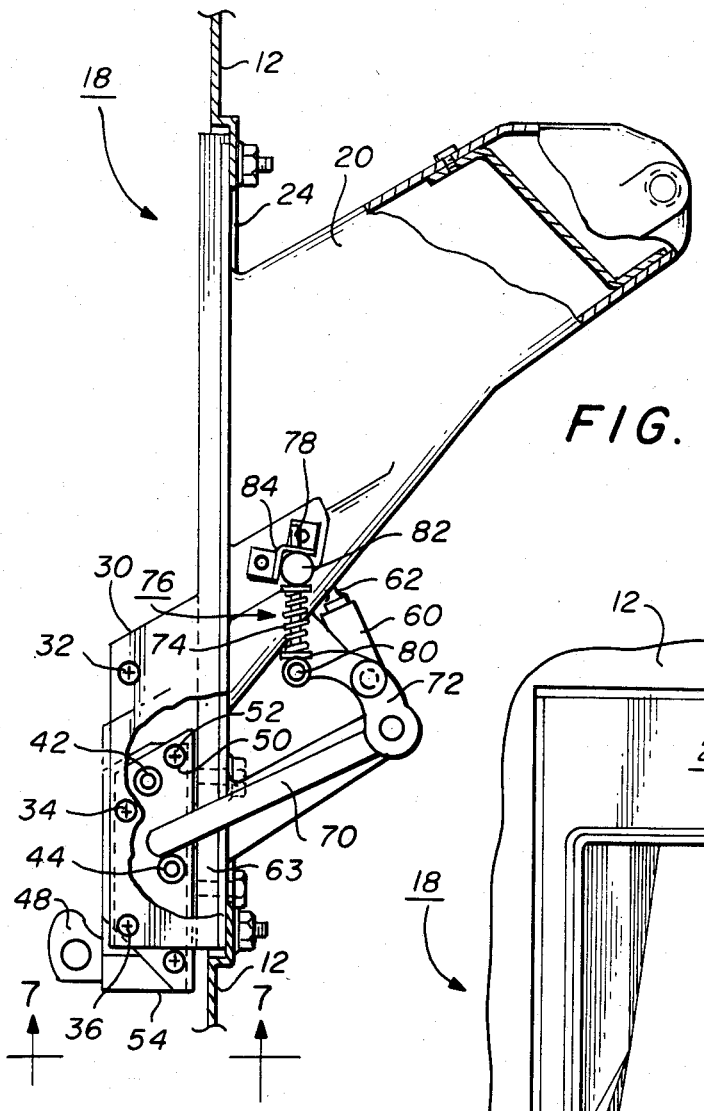
FIG. 5 is a side elevation as seen substantially from the position 5—5 of FIG. 4.
Figure 4:
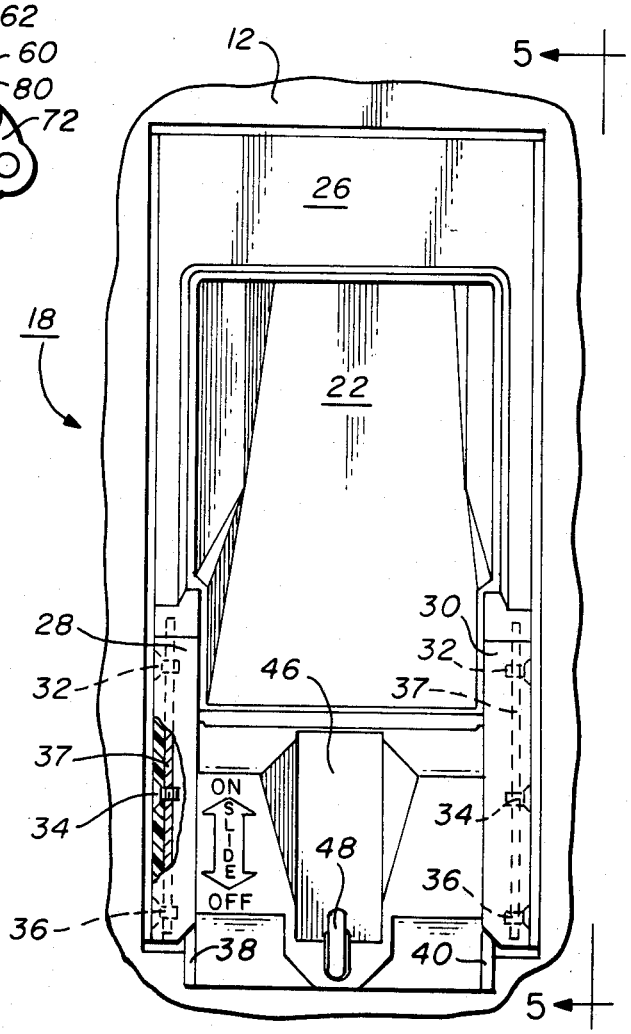
FIG. 4 is a front elevation of the nozzle boot similar to FIG. 2 preset for a standard nozzle size setting of the nozzle boot.
Figure 6:
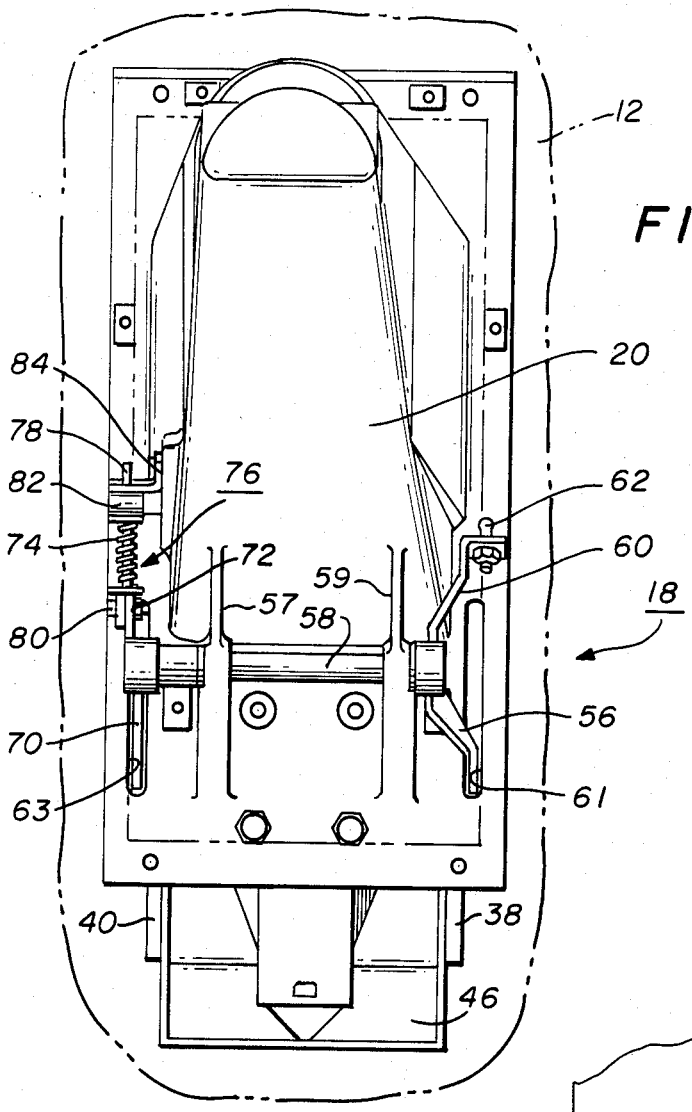
FIG. 6 is a backside elevation as seen substantially along the lines 6—6 of FIG. 3.

As shown in FIG. 3, the upper three apertures 50 are connected to the guide supports via screws 52 in the position setting intended for a vapor recovery nozzle. This results in the lower edge 54 of the nozzle support being positioned a distance "X" below the lowermost edge of the guides. By contrast, for the standard nozzle size setting as illustrated in FIG. 5, a different combination of apertures 50 are utilized for joining the nozzle support to the guides and resulting in the lower edge 54 of the nozzle support being positioned in a horizontal plane substantially coincident with the lowermost edge of the support guides. The effect of the FIG. 5 assembly as compared to that of FIG. 3 is to raise hook 48 so as to provide a smaller nozzle fit within the boot correlated to the standard nozzle size in contrast to the larger fit of FIG. 3 for the vapor recovery nozzle.

As a consequence of the interchangeable mounting arrangement afforded thereby, the mere selection of appropriate mountings in the course of assembly enables nozzle support 46 to be dimensionally positioned to accept a standard size nozzle or alternately can be lowered a distance "X" to support a vapor recovery type nozzle. It can be appreciated that this flexibility of selective settings is accomplished without any unsightly add-ons and with essentially the same materials and labor costs. as would be utilized in a single position nozzle boot.

To electrically actuate and deactuate the dispenser for the dispensing of fuel, the operating switch 68 (FIG. 8) is operated in accordance with the foregoing construction by a vertical sliding displacement of nozzle support 46 as will be described with reference to FIGS. 3–10. For these purposes, lever arms 56 and 70 extend through boot slots 61 and 63, respectively, (FIG. 6) and are secured about pivot shaft 58 journalled in boot ribs 57 and 59. From their connection with shaft 58 the lever arms extend to their distal end between the bosses 42 and 44 on each of the opposite guide supports 38 and 40, respectively.

Joined at the pivot connection between arm 56 and shaft 58 is another lever arm 60 (FIG. 8) secured extending upward therefrom and angled with respect to arm 56. A ball joint 62 supported at the distal end of arm 60 receives the apertured end of an elongated switch actuator arm 64. The opposite end of actuator arm 64 is connected to a rotatable switch plate 66 for energizing switch 68 when arcuately displaced in one direction and deenergizing switch 68 when arcuately displaced in the other direction.

Joined with lever arm 70 at the pivot connection with shaft 58 is an upper lever arm 72 that in turn is connected to an over-center spring device 76 which includes a spring 74 compressed about an elongated pin 78. Pin 78 is mounted on arm 72 via screw 80 and extends through a tubular block 82 and a bracket 84 secured to boot 20.

Figure 9:
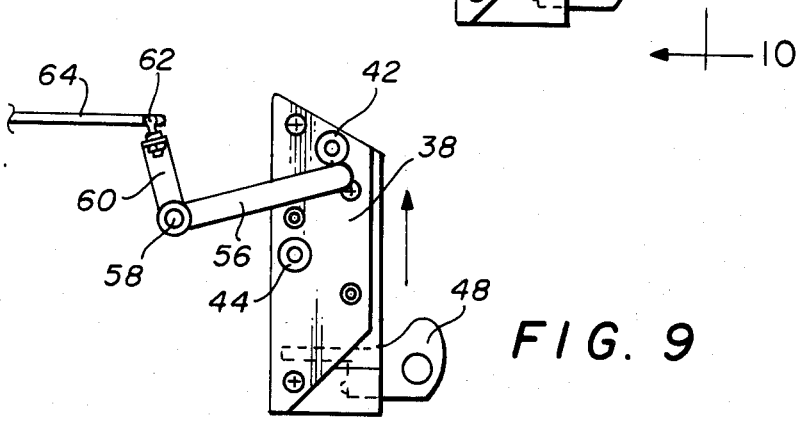
FIG. 9 is similar to FIG. 8 for the "on" position of the dispenser switching mechanism.
Figure 10:
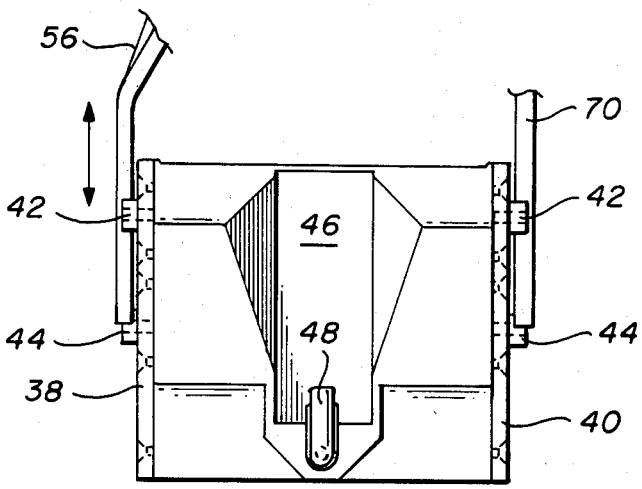
FIG. 10 is a front elevation as seen substantially from the position 10—10 of FIG. 8.

In operation of the switch mechanism, nozzle 16 is first removed from boot 18, after which nozzle support 46 is manually pushed slideably upward by the consumer intending to purchase or otherwise acquire gasoline from the dispenser. The support guides 38 and 40 are always in the same relation with respect to channel 39, regardless of the attached position setting of nozzle support 46. Consequently, initial upward sliding displacement of nozzle support 46, along with the attached support guides 38 and 40 causes guide bosses 44, engaging the underside of lever arms 56 and 70 (FIG. 8) to move the lever arms upwardly. At about mid displacement position, over-center device 76 effects a snap-over operation placing the topside of arms 56 and 70 against the underside of bosses 42 (FIG. 9). In this manner, the dispenser via switch 68 is changed from the dispenser "off" position of FIG. 8 to the dispenser "on" position of FIG. 9. When fuel dispensing has been completed, nozzle 16 is placed onto hook 48, and the opposite occurs as lever arms 56 and 70 are returned to the relation of FIG. 8.

By the above description, there is disclosed a novel nozzle boot for a fuel dispenser able to readily accommodate different size nozzles by the mere substitution of interchangeable assembly points. By a simple and yet effective construction, a long-standing problem has been resolved in accommodating the basically two different size fuel nozzles without the improvisation and inventory problems previously resorted to. Not only does this feature of the invention lend itself to reassembly in response to a customer requirement, but it likewise readily lends itself to a field site change in conjunction with any changeover of nozzle long after the dispenser has been placed into service. Moreover, by virtue of a novel switching mechanism in which the nozzle holder is slideably displaced in a vertical direction outward protrusion of the operating handle is reduced to a minimum for either the "on" or "off" positions, thereby reducing the hazard of snagging by passing customers.

Since many changes could be made in the above construction, and many apparently widely different embodiments of this invention could be made without departing from the scope thereof, it is intended that all matter contained in the drawings and specification shall be interpreted as illustrative and not in a limiting sense.

The embodiments of the invention in which an exclusive property or privilege is claimed are defined as follows:

1. In a fuel dispenser including a cabinet, operating components housed within said cabinet and adapted for connection to a source of fuel for dispensing, a dispenser nozzle, a flexible hose extending connected from said operating components internally of said cabinet to said dispenser nozzle externally of said cabinet, and a nozzle boot receptacle on said cabinet having an opening into which said nozzle can be inserted for supporting said nozzle during periods of non-use, the improvement in said nozzle boot receptacle comprising means to adjustably preset the effective size of said nozzle boot opening to accommodate nozzles of different size.

2. In a fuel dispenser according to claim 1 in which the nozzle boot receptacle of the improvement includes a nozzle support on which to support said nozzle when inserted in said boot, said nozzle support having optional assembly locations for securing said nozzle support to said nozzle boot in a manner effecting relative changes in the size of said nozzle boot opening, and said nozzle support is secured to said nozzle boot at an assembly location selected to effect an effective size of said opening correlated with the size of said nozzle.

3. In a fuel dispenser according to claim 2 in which said optional assembly locations enable securing said nozzle support at either a first assembly location for effecting a first size effective opening for accommodating a standard size dispenser nozzle or a second assembly location for effecting a second size effective opening for accommodating a vapor recovery size dispenser nozzle.

4. In a fuel dispenser according to claims 1, 2 or 3, including support means securing said nozzle support in a slideable relation with respect to said nozzle boot.

5. In a fuel dispenser according to claim 4, including an electrical switch operable for electrically energizing and deenergizing said operating components, and said support means affords slideable displacement of said nozzle support to operate said switch between a first position in which said operating components are electrically deenergized to preclude dispensing of fuel through said nozzle, and a second position in which said operating components are electrically energized to enable dispensing of fuel through said nozzle.

6. In a fuel dispenser according to claim 5 in which said support means affords said displacement of said nozzle support in a vertical plane of said dispenser.

7. In a fuel dispenser according to claim 6 in which said nozzle support when in said first position is in the downmost displacement location on said support means and when in said second position is in the uppermost displacement location on said support means, and said nozzle support is displaceable from said second position to said first position by said nozzle being placed on said nozzle support.

* * * * *